United States Patent [19]

Tsuzuki

[11] Patent Number: 4,545,701

[45] Date of Patent: Oct. 8, 1985

[54] TUNNEL WALL STRUCTURE

[76] Inventor: Junichi Tsuzuki, 6-30-8, Seijo, Setagaya-ku, Tokyo 157, Japan

[21] Appl. No.: 520,385

[22] Filed: Aug. 4, 1983

[30] Foreign Application Priority Data

Aug. 6, 1982 [JP] Japan ..... 57-136888

[51] Int. Cl.[4] ..... E21D 11/00

[52] U.S. Cl. ..... 405/153; 405/150; 52/245; 138/159; 220/327

[58] Field of Search ..... 52/80, 89, 245, 246, 52/247, 248, 224, 227, 228, 229, 580, 582, 583, 587, 640, 645; 138/157, 158, 159, 160; 220/80, 324, 325, 327; 405/150, 151, 152, 153; 403/337, 344

[56] References Cited

U.S. PATENT DOCUMENTS

| | | | |
|---|---|---|---|
| 2,363,156 | 11/1944 | Sinner et al. | 52/582 |
| 3,695,044 | 10/1972 | Hoshino et al. | 405/153 |
| 3,785,097 | 1/1974 | Seymour | 52/227 |
| 4,318,637 | 3/1982 | Oger et al. | 405/153 |
| 4,397,583 | 8/1983 | Hornay et al. | 405/150 |

FOREIGN PATENT DOCUMENTS

| | | | |
|---|---|---|---|
| 2508470 | 4/1976 | Fed. Rep. of Germany | 52/248 |
| 903845 | 8/1962 | United Kingdom . | |
| 984373 | 2/1965 | United Kingdom . | |
| 1232299 | 5/1971 | United Kingdom . | |
| 1232300 | 5/1971 | United Kingdom . | |
| 1257732 | 12/1971 | United Kingdom . | |
| 1385197 | 2/1975 | United Kingdom . | |
| 1467186 | 3/1977 | United Kingdom . | |
| 1501430 | 2/1978 | United Kingdom . | |
| 1502207 | 2/1978 | United Kingdom . | |
| 1585770 | 3/1981 | United Kingdom . | |

*Primary Examiner*—John E. Murtagh
*Assistant Examiner*—Andrew Joseph Rudy
*Attorney, Agent, or Firm*—Body, Vickers & Daniels

[57] ABSTRACT

Arcuate concrete segments of a tunnel wall are joined together in the peripheral direction by abutting steel castings embedded and anchored in the segment ends, and nut and bolt assemblies interconnecting the castings. Longitudinally adjacent segments are joined together by arcuate openings through the segments, nesting positioning members at the interface between the segments, and arcuate nut and bolt assemblies extending through the openings and positioning members.

4 Claims, 15 Drawing Figures

TUNNEL WALL STRUCTURE

BACKGROUND OF THE INVENTION

This invention relates to a tunnel wall structure constructed by a shield process.

In the prior art constructing a tunnel wall structure by the shield process, reinforced concrete segments are assembled progressively using an erector with the progress of a shield machine. There have been proposed various means for joining the concrete segments at the time of the assembly. In one of these means, which is most extensively used in practice, joint members are burried end portions of adjacent concrete segments and clamped by bolts and nuts.

The wall structure that is obtained by assembling the concrete segments in the form of a ring is required that it can perfectly withstand the earth pressure as a whole. In additions the individual concrete segments in the ring-like wall assembly experience a bending moment, which is highest on the inner wall surface. Accordingly, the joints that connect adjacent concrete segments in the peripheral direction of the wall structure are required to have a high tensile strength.

Meanwhile, individual concrete segments have to be comparatively readily positioned in their width direction, i.e., in the direction of the tunnel, and the tunnel wall structure has to be constructed comparatively speedily.

DESCRIPTION OF A PREFERRED EMBODIMENT

Figure 1:
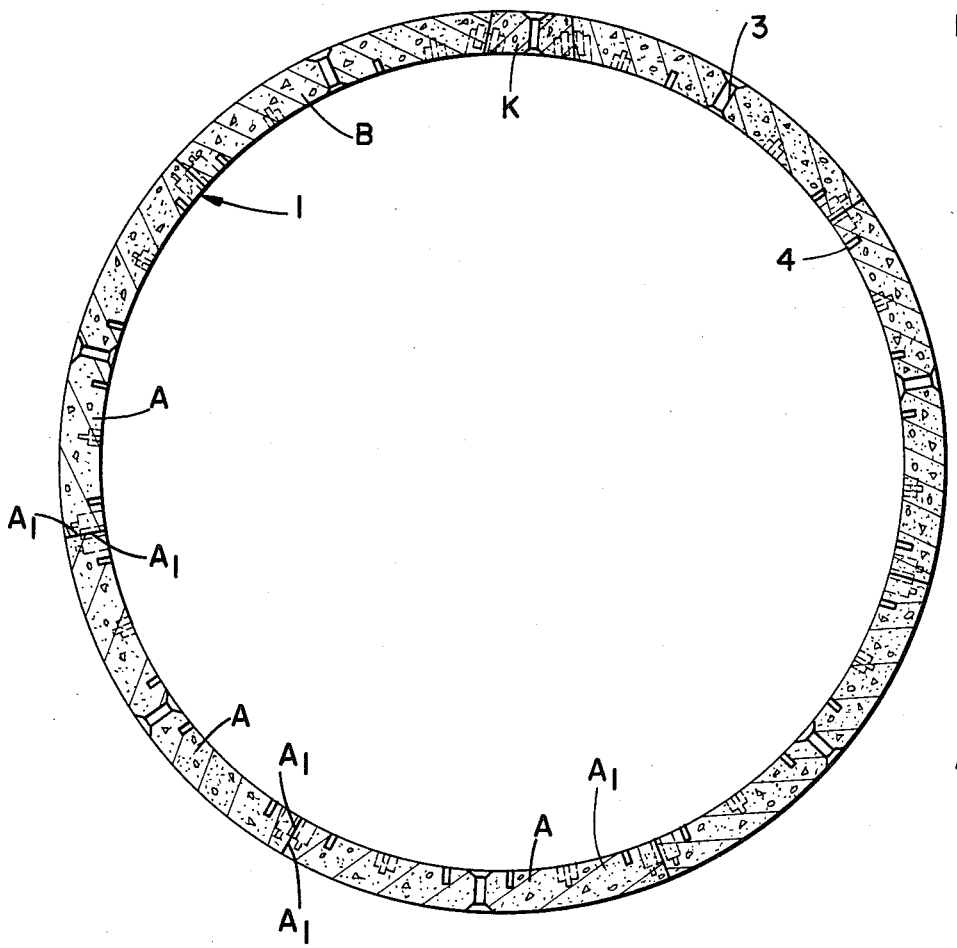
FIGS. 1 and 2 are sectional views of a tunnel wall structure taken in a direction perpendicular to the direction of a tunnel and in the direction of the tunnel respectively.
Figure 2:
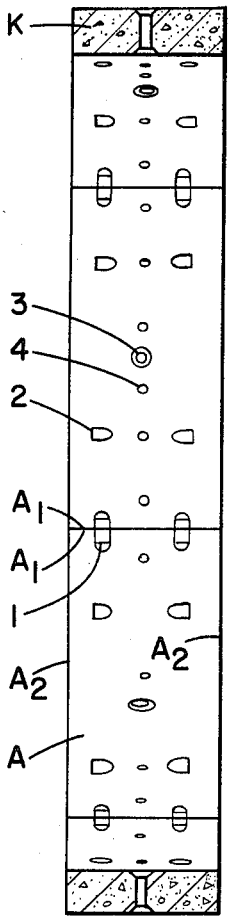

The tunnel wall structure according to the invention has been developed to meet the demands noted above. The embodiment of the invention will now be described in detail with reference to the drawings.

With reference to FIGS. 1–7 of the drawing, the tunnel wall structure according to the invention is obtained by assembling three different kinds of concrete segments A, B and K in the form of a ring and joining such ring-like structures one after another in the width direction of the segments, i.e., in the direction of the tunnel. It will be appreciated from FIG. 1 that the ring has an axis and therefore, from FIGS. 1–3, that the segments, A for example, have circumferentially opposite ends A1 and axially opposite sides A2.

Each concrete segment is provided with joints 1 for the circumferential direction and thus at opposite ends A1 thereof, and joints 2 in the width or axial direction and thus at opposite sides A2 thereof. Further, each concrete segment is provided at its center with a tube-like member 3, into which an end of an erector is screwed at the time of the assembly, and through which a filler material is charged after the ring-like structure has been assembled. Further, each concrete segment has burried inserts 4 provided at suitable positions, which are used for mounting internal construction materials and also for mounting guide members at the time of the assembly.

The joint 1 for the peripheral direction comprises a joint member 5 which is cast from steel. As seen in FIGS. 8, 9, 10 and 14, member 5 has a central bolt hole 6 and is also provided with recesses 7 formed in a portion surrounding the bolt hole 6. The joint member 5 of joint 1 also has opposite side projections 5*a*, which are radially spaced from bolt hole 6 and formed with threaded holes 9 through which anchor bars 8 are screwed. When the joint member 5 is buried in the concrete segment, a block-out 10 is formed on its inner side such that it communicates with the recesses 7.

In assembly, circumferentially ajacent concrete segments are abutted in the circumferential direction so that the mating joint members 5 also abut each other. In this state, a bolt 11 is passed through the aligned bolt holes 6 of the two joint members 5, and a nut 12 is fitted on the bolt 11 and tightened. The segments A and B are united together progressively such that the ring-like wall structure is constructed progressively upwards. Finally, a key segment K is fitted to complete a ring-like structure. Gaps 13 formed between adjacent segments are filled with a seal material.

Figure 3:
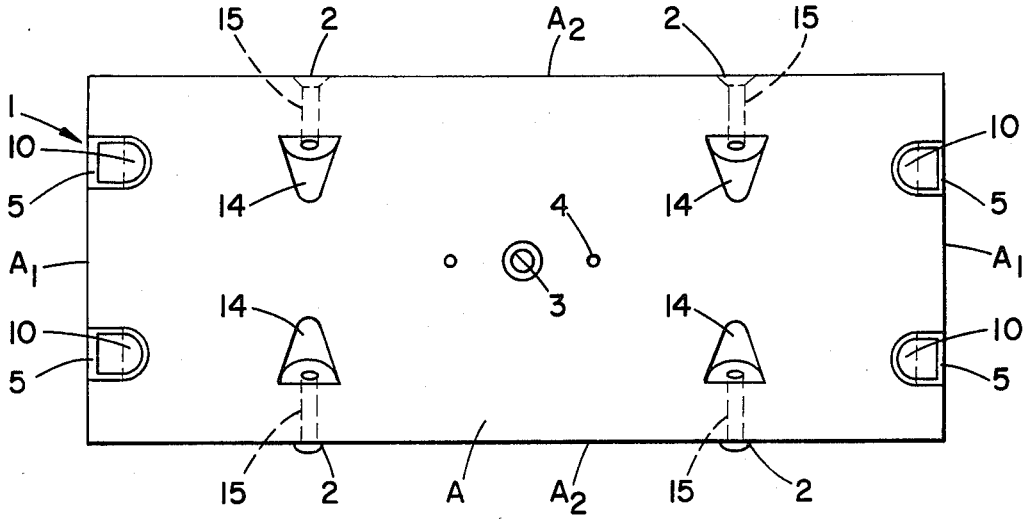
FIGS. 3 and 4 are plan views showing a concrete segment A and a concrete segment K respectively.
Figure 4:
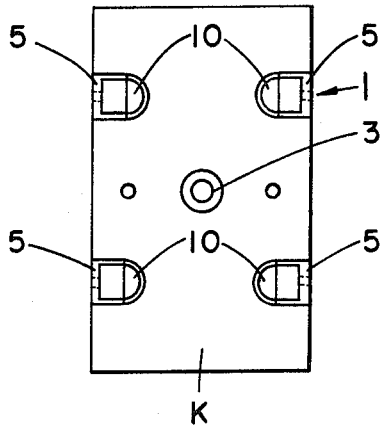
Figure 5:
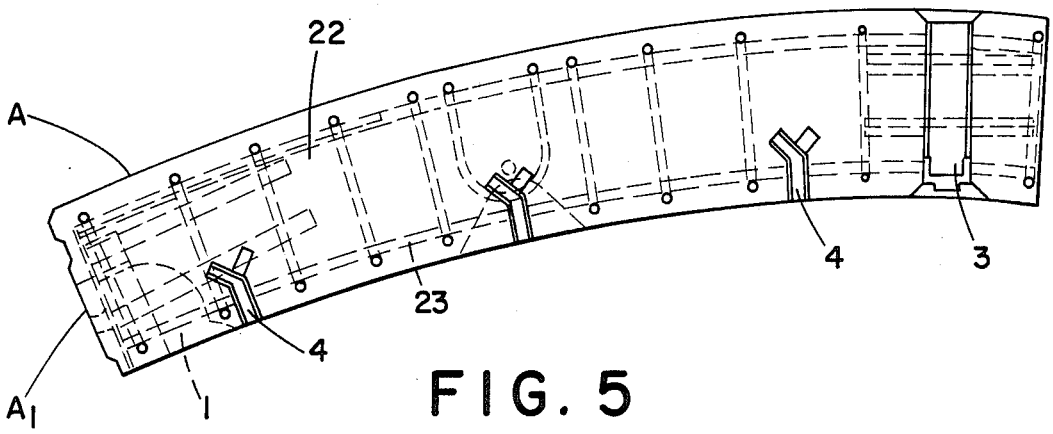
FIGS. 5, 6 and 7 are views showing a segment A taken in the peripheral direction and width direction thereof.
Figure 6:
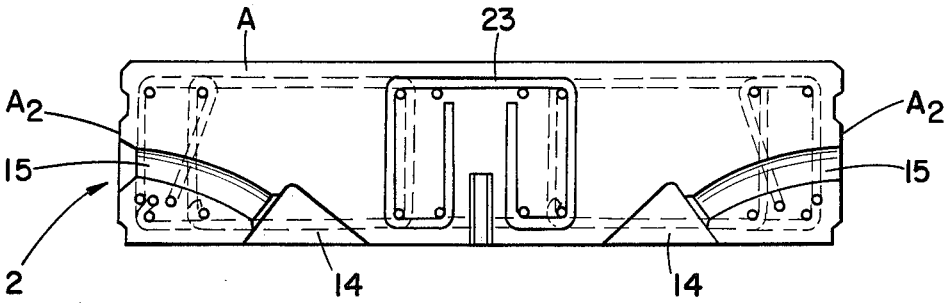
Figure 7:
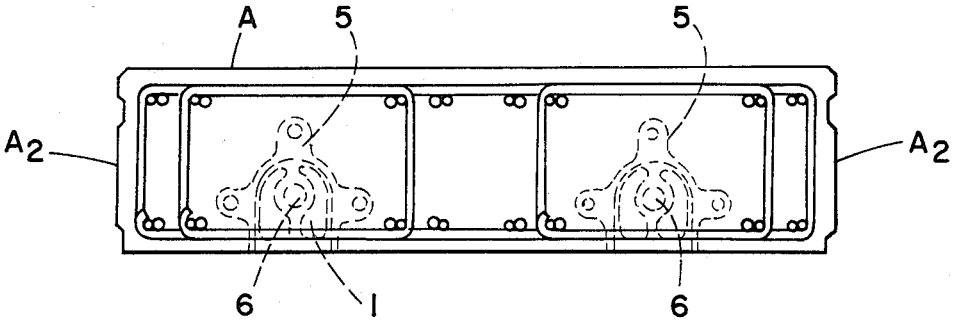
Figure 8:
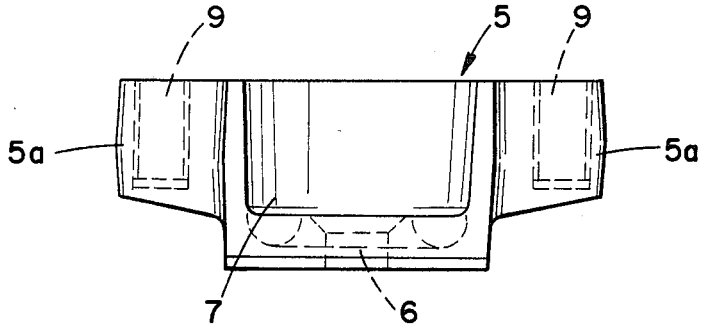
FIGS. 8, 9 and 10 are respectively a front view, a plan view and a side view showing a joint member for peripheral direction.
Figure 9:
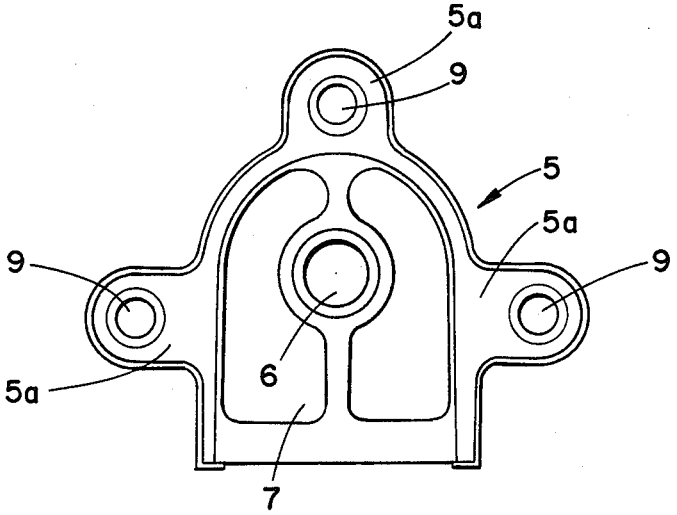
Figure 10:
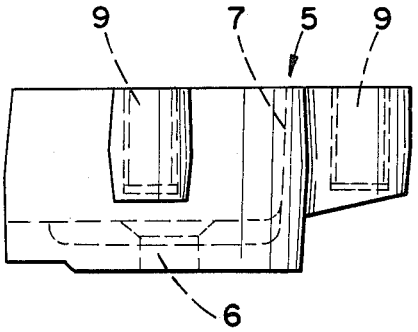
Figure 11:
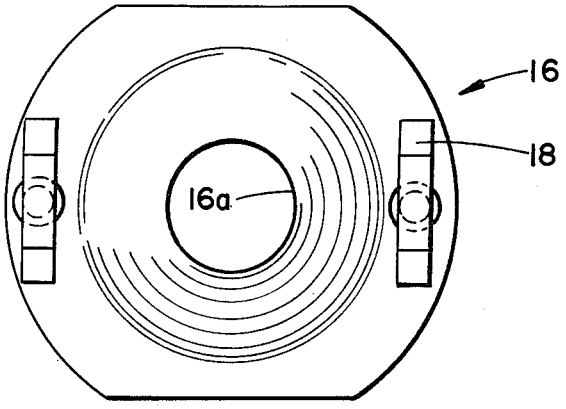
FIGS. 11,12 and 13 show a positioning member in a front view and sectional views.
Figure 12:
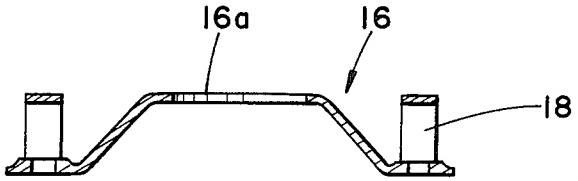
Figure 13:
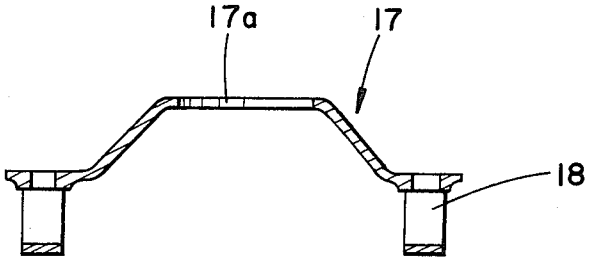
Figure 14:
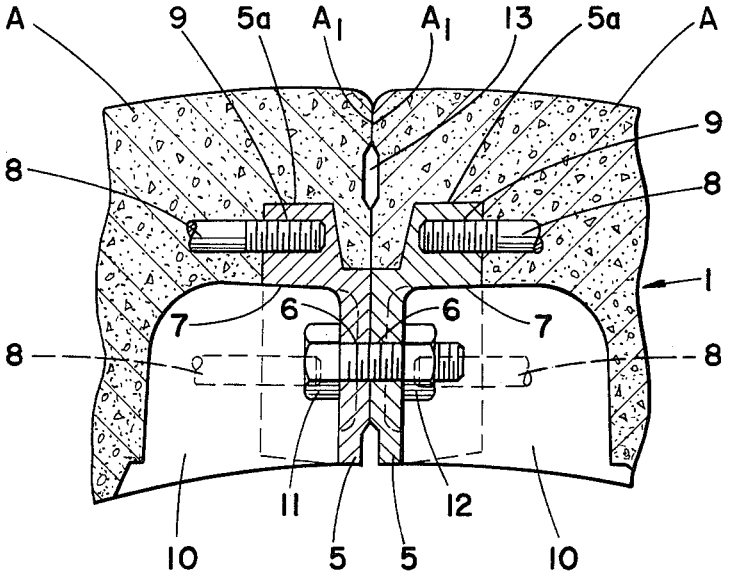
FIGS. 14 and 15 are sectional views showing a joint in peripheral direction and a joint in width direction respectively.
Figure 15:
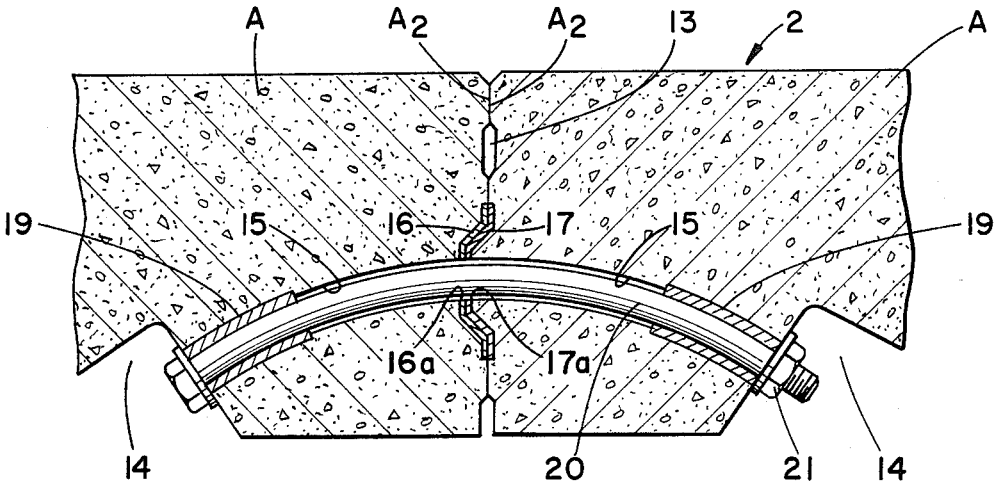

As will be seen in FIG. 3, joint 2 for the axial direction is constituted by a curved bolt hole 15 which is open to the joint boundary or segment side A2 on one hand and to an inner block-out 14 on the other hand. When axially adjacent segments are to be joined together, as shown in FIG. 14, disc-like concave and convex positioning members 16 and 17 shown in FIGS. 11–13 are provided at the joint boundary defined by sides A2 and between the mating bolt holes 15. These positioning members 16 and 17 have openings 16*a* and 17*a* therethrough, respectively, and are secured in position by anchor members 18. A guide pipe 19 is provided in the bolt hole 15 in a portion thereof adjacent to the inner end open to the block-out 14.

In assembly, the concave and convex positioning members 16 and 17 of axially adjacent concrete segments are mated with each other. In this state, a curved bolt 20 is passed through the mated and communicated bolt holes 15, and a nut 21 is fitted on the bolt 20 and tightened. In this way, axially adjacent concrete segments can be assembled together in the direction of the tunnel. Gaps 13 formed between adjacent concrete segments abutted in the axial direction thereof are also filled with a seal material.

In the Figures, designated at 22 is concrete, and at 23 reinforcing bars.

As has been described in the foregoing, according to the invention individual concrete segments are united together in the circumferential direction by joining together abutted steel casting joint members, which are secured to the abutted concrete segments by anchor bars and provide for a comparatively high mechanical strength, with a bolt and a nut. Thus, it is possible to obtain an assembly and joints of a high tensile strength.

Also, the assembling work itself is simple like the prior art assembly using bolt and nut.

Further, use is made of concave and convex positioning members for the assembly of adjacent concrete segments in their axial direction to facilitate the positioning of the segments and alignment of mated bolt holes. The positioning members further have an effect of reinforcing the bolt holes and also improving the shearing strength after the concrete segments are assembled. The invention is thus very beneficial in industry.

I claim:

1. A tunnel wall structure comprising a plurality of rings, each said ring having an axis and being comprised of a plurality of arcuate segments of reinforced concrete having circumferentially opposite ends and axially opposite sides with respect to said axis, circumferentially adjacent segments of each ring having circumferentially abutting ends, said plurality of rings being axially adjacent to one another and axially adjacent to said segments of said rings having axially abutting sides, first joint means between said circumferentially abutting ends comprising a pair of circumferentially opposed joint members each embedded in a corresponding portion of said abutting ends, said joint members having aligned central bolt holes opening circumferentially therethrough, said first joint means further including anchor members secured to said joint members and extending circumferentially therefrom into the corresponding segment, and a first bolt extending through said aligned central bolt holes and receiving a first nut to hold said circumferentially adjacent segments together, and second joint means between said axially abutting sides of said axially adjacent segments, said second joint means including aligned curved bolt holes extending axially through the abutting sides of said axially adjacent segments, a concave positioning member secured on each of said abutting sides of said axially adjacent segments, said positioning members having openings aligned with said curved bolt holes and being in mating engagement with one another, and a curved second bolt extending through said curved bolt holes and said openings through said positioning members, and said curved bolt receiving a second nut to hold said axially adjacent segments together.

2. The tunnel wall structure according to claim 1, wherein each said joint member includes a recessed portion surrounding said central bolt hole and projections spaced radially outwardly from said bolt hole and formed with threaded holes, said anchor members being screwed in said threaded holes.

3. The tunnel wall structure according to claim 1, wherein each said positioning member is provided with anchor members embedded in the corresponding segment.

4. The tunnel wall structure according to claim 1, wherein each curved bolt hole has an inner end axially spaced from said abutting sides, and a guide pipe extending into each of said inner ends toward said abutting sides.

* * * * *